US009126655B2

(12) United States Patent
Swan

(10) Patent No.: US 9,126,655 B2
(45) Date of Patent: Sep. 8, 2015

(54) CONVERTIBLE INFLATABLE BOAT WITH STAND UP PADDLEBOARD

(71) Applicant: Richard L. Swan, Reno, NV (US)

(72) Inventor: Richard L. Swan, Reno, NV (US)

( * ) Notice: Subject to any disclaimer, the term of this patent is extended or adjusted under 35 U.S.C. 154(b) by 3 days.

(21) Appl. No.: 14/193,308

(22) Filed: Feb. 28, 2014

(65) Prior Publication Data

US 2014/0245943 A1 Sep. 4, 2014

Related U.S. Application Data

(60) Provisional application No. 61/771,085, filed on Mar. 1, 2013.

(51) Int. Cl.

| | |
|---|---|
| ***B63B 3/00*** | (2006.01) |
| ***B63B 7/08*** | (2006.01) |
| ***B63B 35/79*** | (2006.01) |
| ***B63H 16/06*** | (2006.01) |
| *B63B 35/73* | (2006.01) |

(52) U.S. Cl.

CPC ..... *B63B 7/087* (2013.01); *B63B 7/085* (2013.01); *B63B 35/795* (2013.01); *B63B 35/7913* (2013.01); *B63H 16/06* (2013.01); *B63B 2035/738* (2013.01)

(58) Field of Classification Search

USPC ..... 441/66, 74; 114/345, 259
IPC ..... B63B 7/08
See application file for complete search history.

(56) References Cited

U.S. PATENT DOCUMENTS

| | | | | |
|---|---|---|---|---|
| 4,779,555 | A * | 10/1988 | Hong | 114/345 |
| 5,184,564 | A * | 2/1993 | Robbins et al. | 114/345 |
| 6,209,476 | B1 * | 4/2001 | Maurel et al. | 114/345 |
| 8,696,396 | B1 * | 4/2014 | Churchill et al. | 441/66 |
| 8,702,461 | B1 * | 4/2014 | d'Offay | 441/40 |
| 2008/0207068 | A1 * | 8/2008 | Rockstad et al. | 441/66 |
| 2010/0229778 | A1 * | 9/2010 | Chang | 114/345 |
| 2011/0036284 | A1 * | 2/2011 | Chon | 114/345 |
| 2013/0137319 | A1 * | 5/2013 | Haller et al. | 441/66 |

* cited by examiner

*Primary Examiner* — Stephen Avila
(74) *Attorney, Agent, or Firm* — Southeast IP Group, LLC.; Cameron C. Applegate; Thomas L. Moses

(57) ABSTRACT

An inflatable shallow draft fishing boat having a removable, inflatable paddleboard floor that provides stable flotation for at least two standing adults, the boat also including an adjustable, detachable rowing frame. The boat can be maneuvered and propelled by oars, a push pole or a small motor. The detachable rowing frame may hold a cooler seat and may also serve as an elevated push poling platform. The rowing frame allows the rower to switch his rowing position from facing the stern (for best speed) or face the bow (for better visibility when searching for fish). The paddleboard floor may be held in place by frictional engagement when the boat and the paddleboard are inflated; alternatively, the paddleboard may be removed and function independently as a stand-up paddleboard that can be used for fishing, swimming, or similar recreational water sports.

19 Claims, 7 Drawing Sheets

FIG. –4–

CONVERTIBLE INFLATABLE BOAT WITH STAND UP PADDLEBOARD

BACKGROUND OF INVENTION

The sport of fishing for bone fish, permit and tarpon has been growing in popularity for half a century. The sport commonly referred to as "flats fishing" requires anglers to pursue their query on salt water flats which range from a few inches to a couple of feet in depth. A number of hard shelled boats, generally called flats boats or flats skiffs, have been designed to carry fishermen to and upon these productive salt water shallows. The problem is these craft are expensive, require substantial vehicles with trailers for transport and require a large commitment of time and money to store and maintain them.

Inflatable boats have been in use for decades. A common design includes two parallel side tubes that curve together in the front forming a bow. In the stern, the two parallel side tubes attach to and are connected by a transom. A bottom piece is glued or welded to the bottom of the side tubes, transom, and bow forming a water proof seal resulting in a conventional inflatable boat with a dry interior.

Stand up paddleboarding (SUP) has been growing in popularity for several years now and offers a fun, relaxing way to enjoy the water. This aquatic activity involves employing an oversized surfboard in combination with a paddle for propulsion. With a minimum of gear, you can paddle ocean surf, lakes and rivers with no waves required. A paddleboard is light and easy to transport, so one can easily access water that boats cannot. Additionally, paddleboarding delivers a full body workout and has become a popular cross-training activity. The paddleboards available on the market today include rigid foam or fiberglass boards and inflatable boards.

Inflatable stand up paddleboards have been in use for several years and are constructed by making an inflatable drop stitch (DS) air-tight envelope of PVC impregnated polyester fabric or other coated or impregnated fabric into the shape of a conventional paddleboard that can be inflated through a valve. This drop stitch manufacturing creates a board that may be inflated to very high pressures, resulting in rigidity similar to a hard board. Some benefits of inflatable boards over hard boards are their durability and transportability.

One object of the present invention is to provide a light weight inflatable boat that includes a conventional inflatable paddle board designed to closely fit inside the floor of the boat, so that when both are inflated the resulting air pressure and friction firmly join the two together. This combination makes it possible for two people to stand up and cast fishing lines, stand up and pole with a push pole, stand up to search for fish, or use the resulting stable platform to dive or step into the water. An essential part of this invention is that the boat can be deflated, and the paddleboard floor can easily be removed, re-inflated and used as an inflatable stand up paddleboard. This version of watercraft is portable in the trunk of a medium sized automobile or SUV and can be owned and operated at a fraction of the cost of the larger, heavier, flats craft which are made out of rigid materials such as wood, fiber glass, or metal.

None of the prior art discloses or describes an inflatable boat designed to have an inflatable paddleboard floor that provides stability for fishing and diving, wherein the floor can be removed and function independently as a stand up paddleboard.

SUMMARY OF THE INVENTION

It is a general object of the present invention to improve the utility of the prior art of inflatable boats and stand up paddleboards by incorporating the two into a single, easily portable watercraft. Provided is an inflatable boat including a stand up paddleboard functioning as the floor of the boat, wherein the paddleboard may be removed and used independently as a watercraft.

An example paddleboard comprises a floating body having a long midline axis, a bow end, a stern end, a top surface and a bottom surface. The top region optionally comprises a slip resistant material, which can optionally extend from the bow to the stern. The paddleboard further comprises a deck region located on the top surface on which a user stands to operate the stand up paddleboard. The deck region alone can optionally comprise the slip resistant material.

A further object of the present invention is to construct an inflatable boat and paddleboard which can be easily maneuvered as one or separate units in shallow water by oars, push pole, paddle, or electric motor.

A further object of the present invention is to construct an inflatable boat which is suited for rod and reel fishing methods on shallow water flats and particularly for fishing for bone fish, tarpon, snapper and permit as well as suited for slow-moving rivers and shallow fresh water fishing for bass, carp, panfish, and trout.

A further object of the present invention is to construct an inflatable boat/paddleboard combination which is affordable, can be transported in the trunk of an automobile, and can be stored in a closet or small storage room.

Yet another object of the present invention is to construct an inflatable boat which does not unduly alarm the shallow water game fish targeted by the user.

Yet another object of the present invention is to construct an inflatable boat which provides a convenient elevated platform for the person maneuvering the craft by push pole to step up on a platform and achieve a higher elevation for improved viewing of game fish. In one embodiment, an ice cooler held in place by a detachable metal frame may provide such a platform.

Still another object of the present invention is to construct an inflatable boat which can be maneuvered by rowing and said person can easily shift his rowing position from facing the stern to facing the bow so he can more accurately maneuver the boat to an advantageous position to cast to approaching fish.

An additional object of the present invention is to construct an inflatable boat in which the operator can sit on a rowing seat near the stern and operate a small gas or electric motor with the optional assistance of a tiller extension.

Still another object of the present invention is to construct a stand up paddleboard that is stable enough for a person to stand on and cast for fish.

Yet another object of the present invention is to construct a stand up paddleboard that may include a plurality of attachment mechanisms to allow for easy and secure attachment of fishing and outdoor gear such as a cooler, paddles, fishing rods, life preservers, nets, and the like.

DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
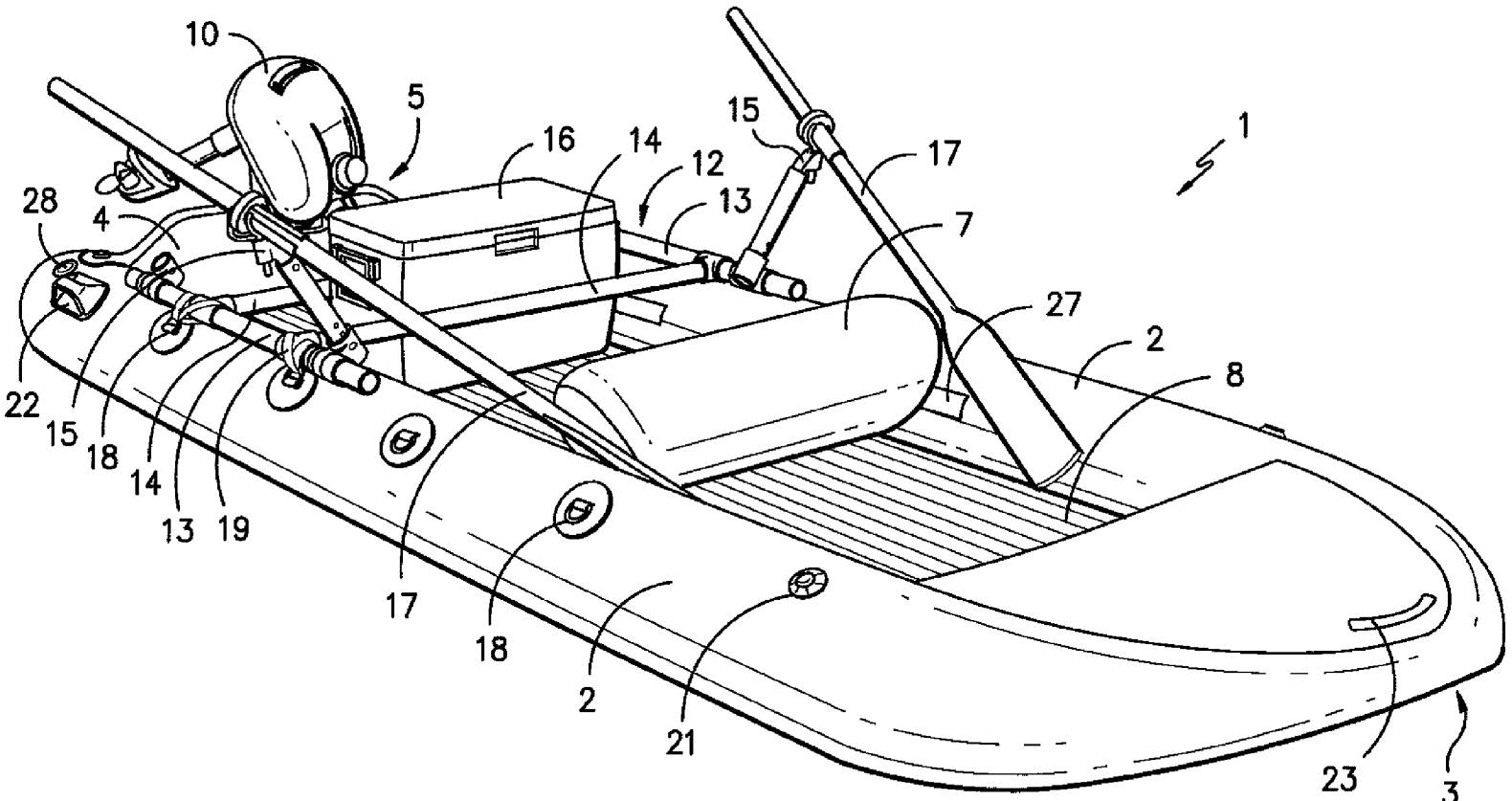
FIG. 1 illustrates a perspective view of the inflatable boat with stand up paddleboard floor, further including the rowing frame with oar locks and cooler seat.
Figure 2:
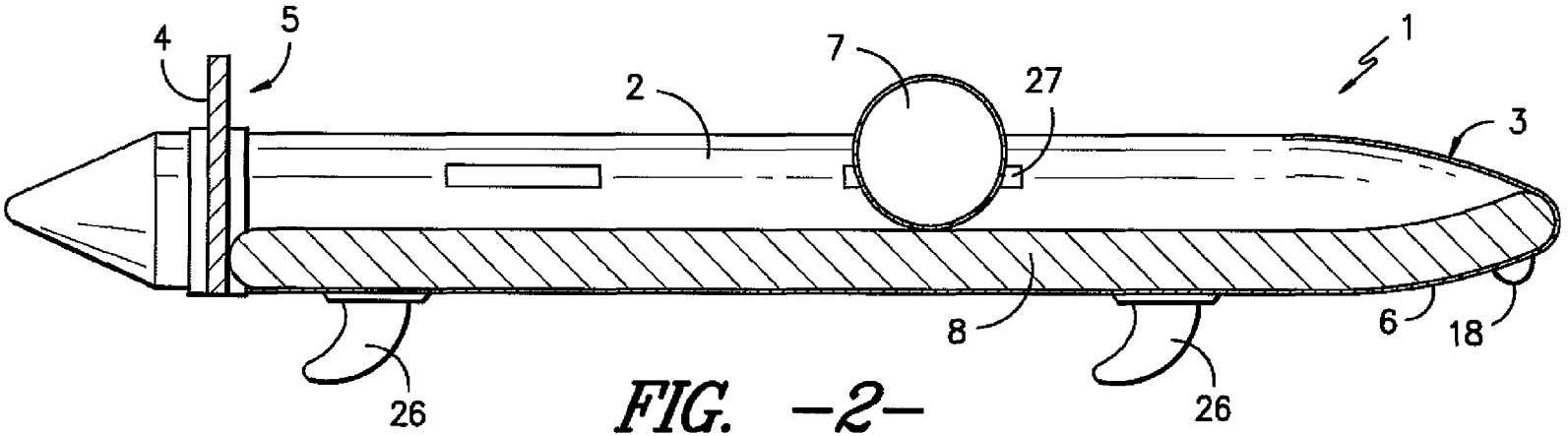
FIG. 2 illustrates a longitudinal cross-sectional view of the inflatable boat with stand up paddleboard floor.
Figure 3:
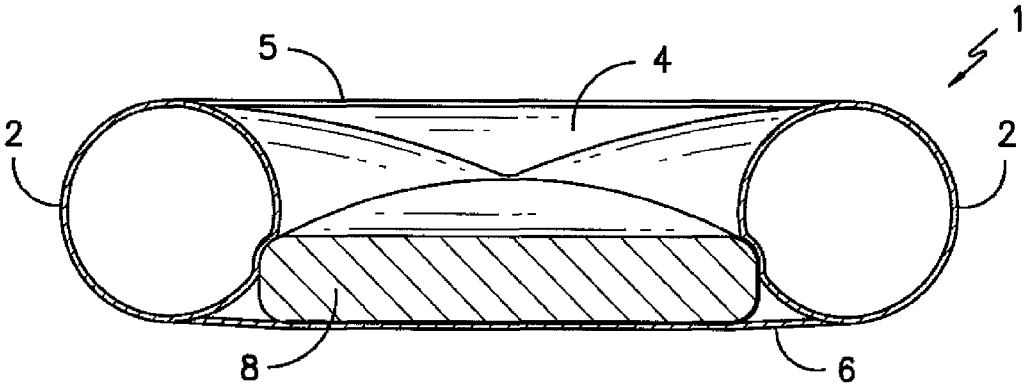
FIG. 3 illustrates a transverse cross-sectional view of the inflatable boat with stand up paddleboard floor.
Figure 4:
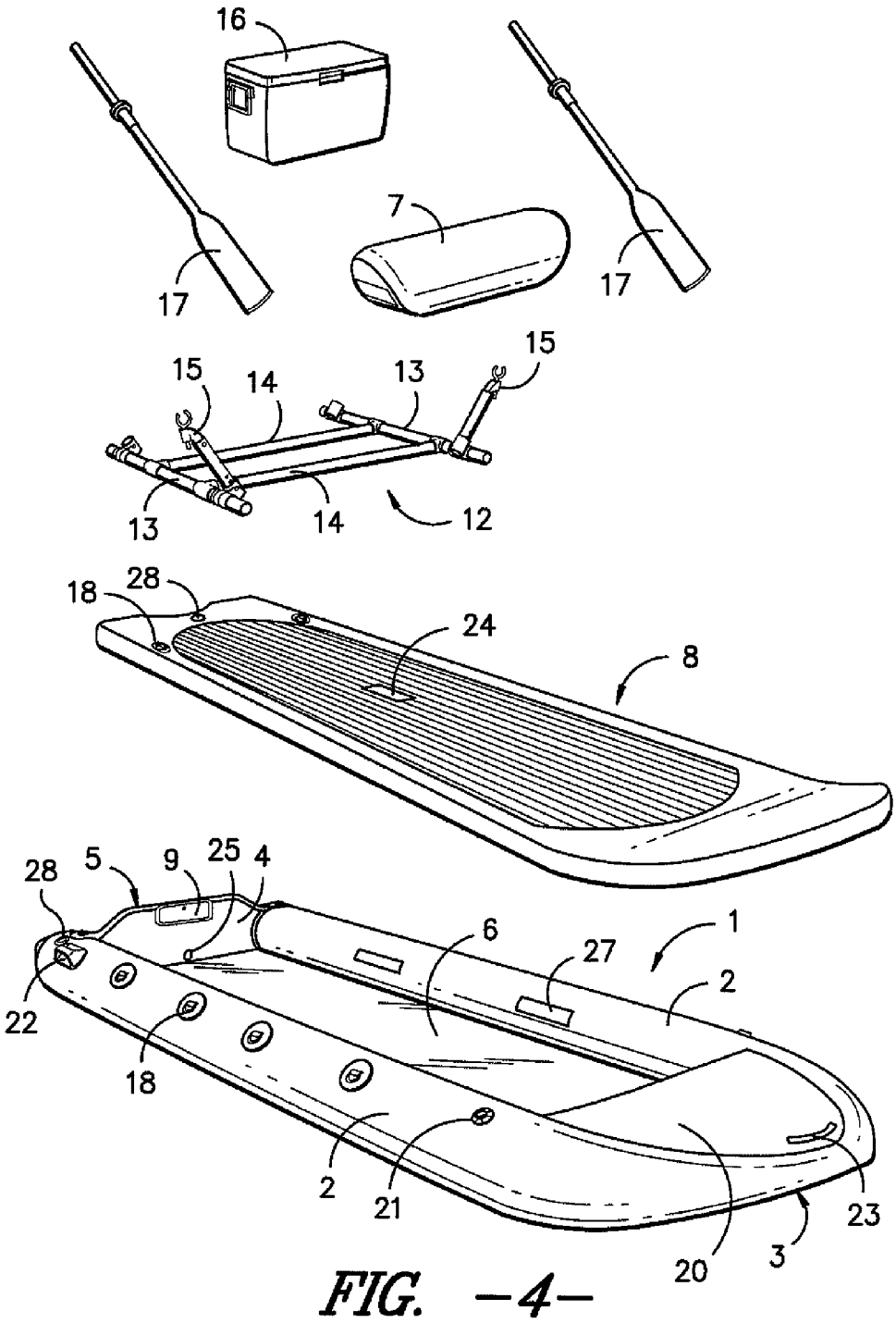
FIG. 4 illustrates an exploded view of the inflatable boat, inflatable stand up paddleboard, rowing frame, removable thwart, cooler seat, and oars.
Figure 5:
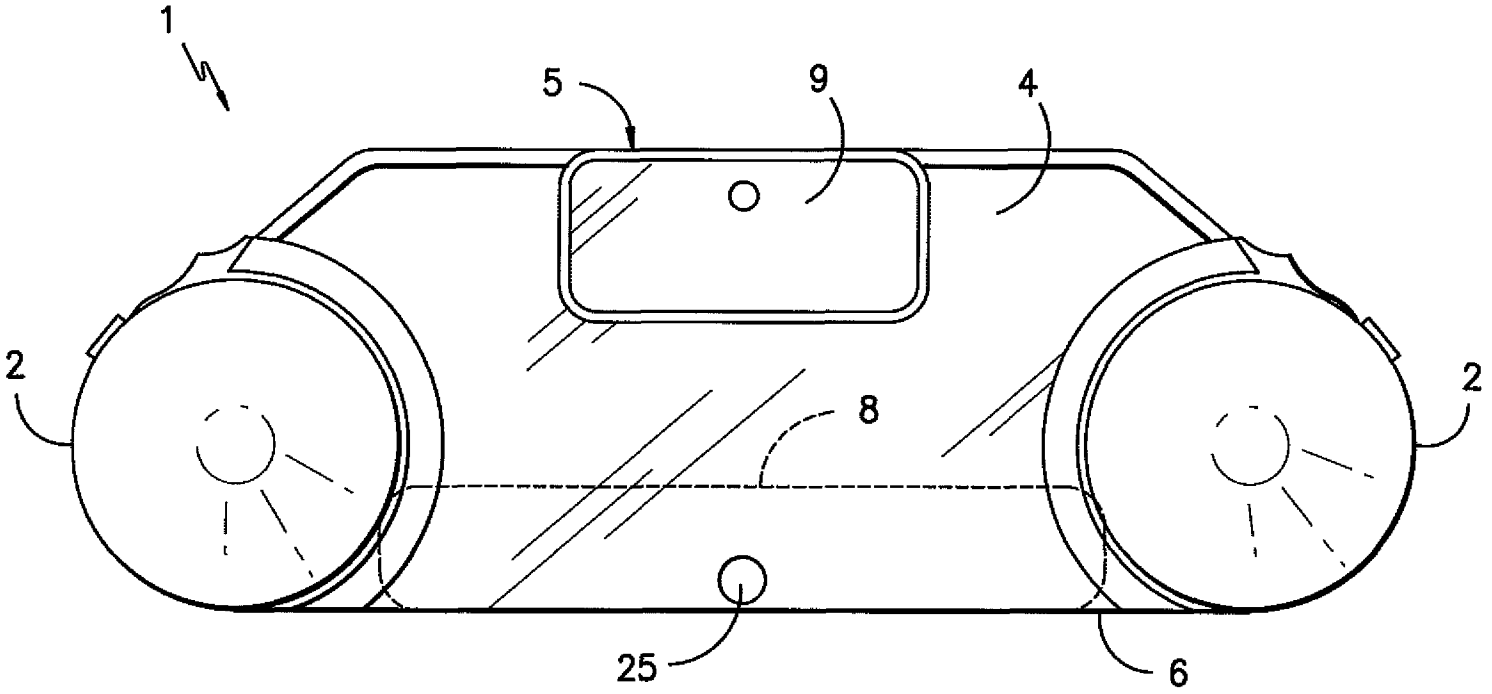
FIG. 5 illustrates a rear view of the stern end of the inflatable boat with stand up paddleboard.
Figure 6:
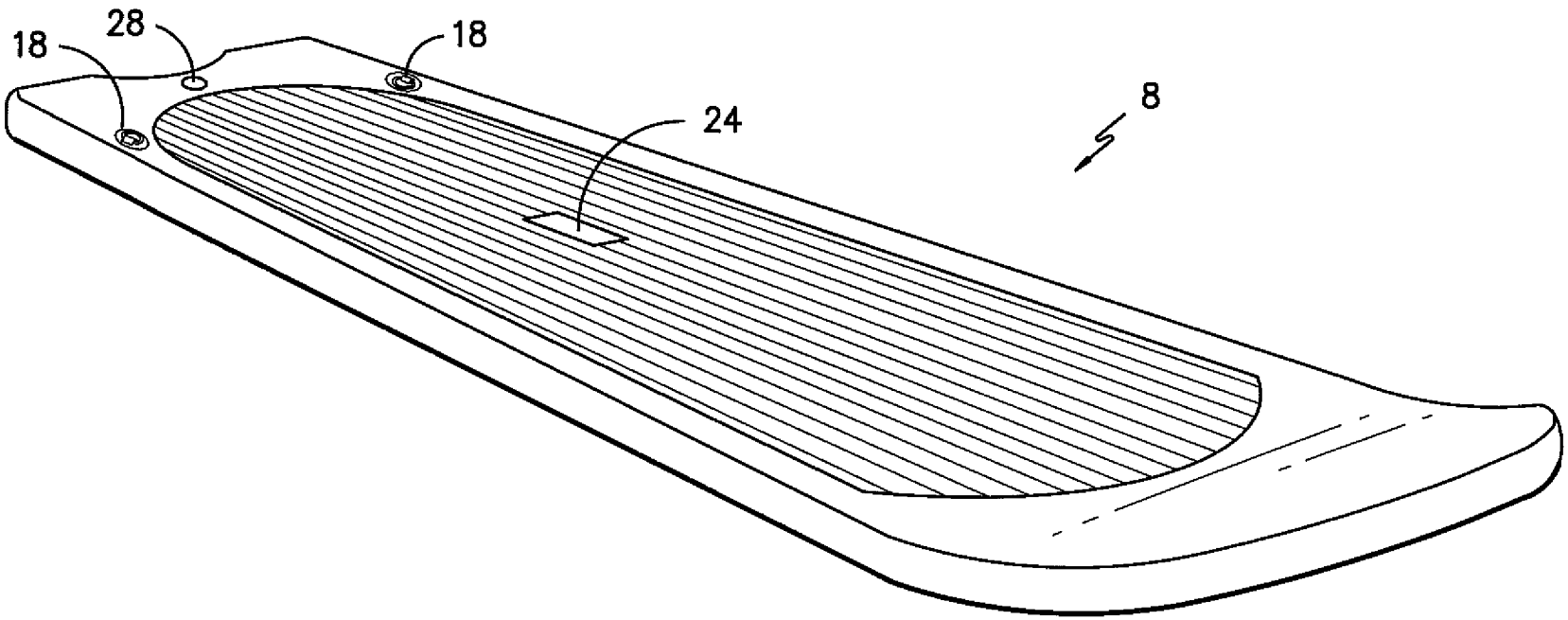
FIG. 6 illustrates a perspective view of the inflatable stand up paddleboard.
Figure 7:
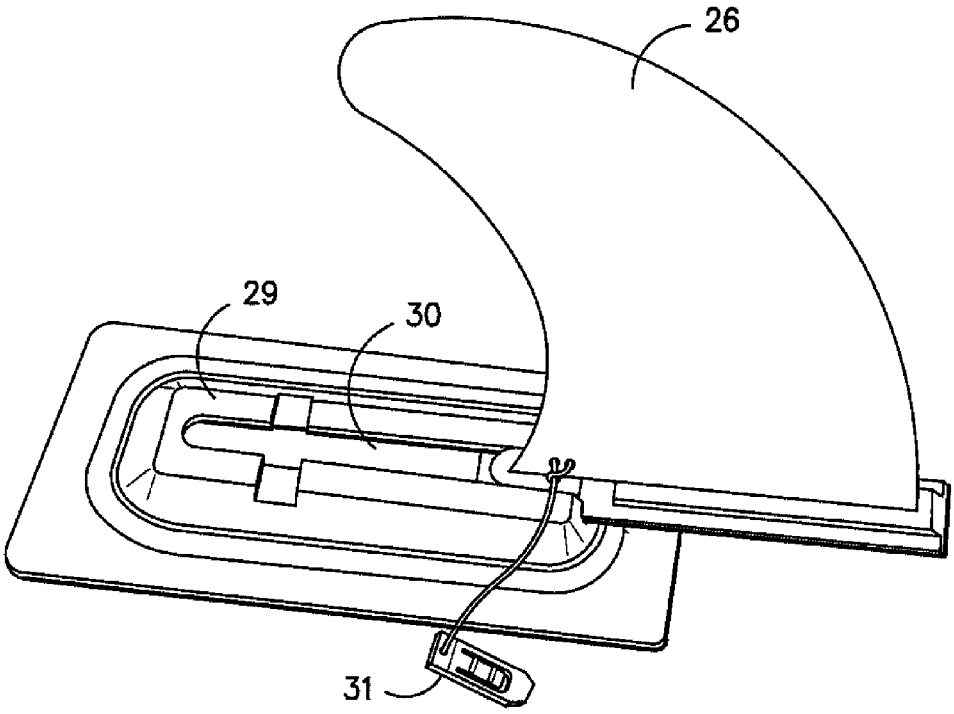
FIG. 7 illustrates the removable paddleboard fin as it slides into the groove of the track.
Figure 8:
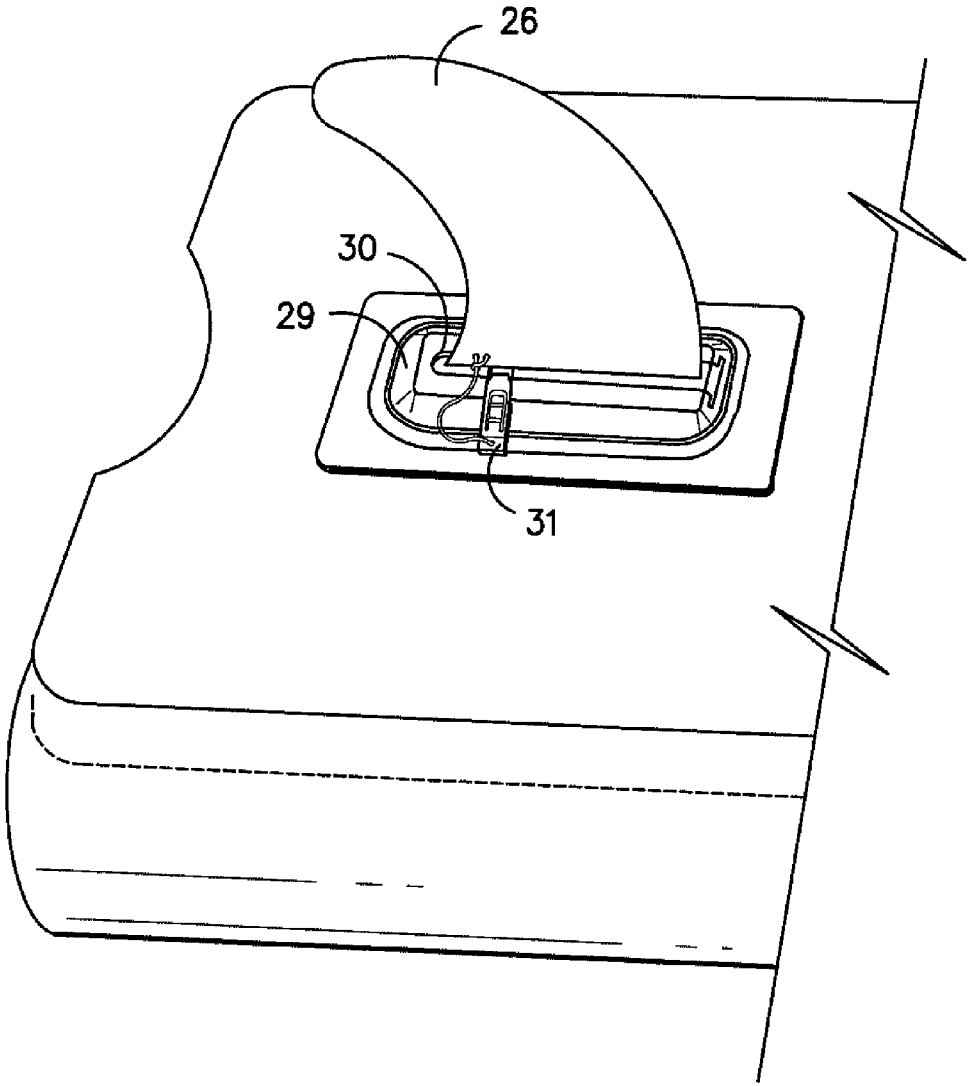
FIG. 8 illustrates the removable paddleboard fin fully engaged in the track with insertion of a locking pin.

In one embodiment, the sides of an inflatable boat 1 are defined by two elongated tubes 2 preferably about 12.5 feet long, forming a boat about 4 feet wide. The two side tubes 2 come together in the front to form a bow 3 and may further curve up near the bow 3 about 12 inches to help prevent waves from breaking over the bow 3 and into the boat 1 when underway. The two side tubes 2, preferably about 11 inches in diameter, connect to a transom 4 on the stern end. The stern 5 may have a motor mount portion 9 which includes sufficient strength and rigidity to attach a small outboard motor 10 or a small electric motor 10. A plastic or rubber bottom member 6 is attached with a watertight seal at the bottom of the side tubes 2 from the tip of the bow 3 to the bottom of the transom 4 to form the bottom of a watertight vessel or boat. An inflatable, removable thwart 7 may be used to provide a seat near the bow 3. It may be held in place by hook and loop tape 27, for instance, which connects it to the inside of each side tube 2. The inflatable components of this watercraft may include at least one valve 28 for inflation and at least one pressure relief valve 21.

The inflatable boat 1 may also include an ice cooler 16 used as a rear seat, which preferably sits about 2 feet ahead of the stern 5. This cooler/seat 16 is held in place by a rectangular frame 12 (also referred to herein as a "rowing frame"), which may include oarlocks 15 located on both ends of the side tubes 2. The rowing frame 12 preferably consists of 4 support members. Two lateral support members 14 run perpendicularly across the boat 1 and attach to two longitudinal support members 13 that rest on and are parallel to the inflated side tubes 2. In one embodiment, each of these longitudinal support members 13 of the frame 12 may extend about 12 inches past the lateral support members 14 toward the bow 3 on the front side of the cooler 16 and about 12 inches toward the stern 5 on the back side of the cooler 16. When the paddleboard 8 is removed from the boat 1, the oars 17 may be removed from the oarlocks 15 and used to propel the paddleboard 8.

The cooler 16 may be placed into the rowing frame 12, and may be removed when not in use. At least one pair of removable, adjustable oarlocks 15 may be provided along an upper portion of the inflatable side tubes 2 in such a way as to allow the person rowing to switch orientation from facing the stern 5 to facing the bow 3, which allows him to see fish and more effectively maneuver the boat 1 in favor of the person fishing in the front of the boat 1. The oarlocks 15 may be adjustable in such a way that they may slide along the longitudinal support members 13 and may be adjusted to accommodate the height of the rower. The frame 12 is preferably adjustable so that it can securely lock different sized coolers in place as a seat for rowing. This adjustability may be accomplished by providing the lateral support members 14 to slide in either direction along the longitudinal support members 13 and then be locked into a desired position. The cooler 16, while in place within the frame 12, may be used as a seat for operating a small horsepower motor 10. And the cooler 16 may also be used as push-pole poling platform to pole the boat 1 from an elevated station, which is advantageous for spotting fish. In an alternate embodiment, a seat/platform can be formed by building a seat into the frame 12 from wood, plastic, or other suitable material.

In one embodiment, the frame 12 may be detachable and held in place, for instance, with D rings 18 and straps 19 or cords to steady the cooler seat 16 when being used as a poling platform or as a rowing seat. The rowing frame 12, in a preferred embodiment, is collapsible when removed from the boat 1 for easy transport with the deflated boat in the trunk of a car. This collapsibility may be accomplished through snap-fit joints, folding joints, or other similar connection mechanisms. The rowing frame 12 may position the cooler seat 16 about 24 inches from the stern 5. When the boat 1 is being maneuvered with the push pole, the poling person can easily step up from his position behind the cooler 16 to the top of the cooler 16 for better visibility. He can also sit on the cooler 16 when operating a small out board gas or electric motor 10.

It should be noted that the boat 1 may be operated in a variety of ways and embodiments. The rowing frame 12 is optional, and the boat 1 may be operated without the frame 12 in place. A person may paddle, pole, or motor the boat 1 while the frame is detached. Additionally, the motor 10 may be removed, and the boat 1 may be operated exclusively by poling or paddling.

In a preferred embodiment, at least one drain 25 may be disposed in the bottom of the boat 1, preferably centrally located on the bottom of the transom 4 or in the stern 5 end of the boat 1, allowing water that splashes in the boat 1 to drain out. The drain may be a scupper or a drain with a plug or screw cap, or other suitable structure to facilitate drainage and removal of water. A bow cover 20 may extend back from the bow 3 about 24 inches, thus creating a storage area that allows stowage of rain coats shoes and other gear. The boat 1 is preferably white in color on sides and tops of tubes to reflect sun light so the craft is less visible to fish. White is the color of most fish eating sea birds for the same reason, and is therefore advantageous for fishing purposes.

One or more D-shaped plastic fins 26 may be attached to the bottom of the boat 1 to improve directional stability. The straight side of the D-shaped fin 26 is parallel to the bottom of the boat 1. In a one embodiment, a D-shaped fin, preferably 6 inches in length and extending into the water about 2 inches, may be permanently attached to the stern end of each side tube 2.

The top side of the bow 3 may include a carrying handle 23 and the underside of the bow 3 preferably has a large D ring 18 to which a bow line can be attached to secure the boat 1 to a dock, piling or anchor. The stern of both side tubes 2 each may include a similar carrying handle 22 and may also be used to tie the boat 1 off to a dock or mooring.

A removable, inflatable paddleboard 8 preferably 6 inches thick sits just above the bottom member 6 and inside the boat 1. The combination of the inflated boat 1 and the inflated paddleboard 8 creates a buoyant, stable boat with a firm floor allowing two adults to stand up and cast fishing lines from the boat 1.

The paddleboard 8 is held securely in place directly above the bottom member 6 of the boat 1 by a tight fit that may be accomplished through static friction resulting from air pressure between the side tubes 2 of the boat 1 and the sides of the paddleboard 8. The paddleboard 8 may be shaped to contact the inside edges of the side tubes 2 and transom 4 of the boat 1, preferably tapered and rounded on the bow end giving the paddleboard 8 a typical bow shape, while being squared off on the stern end to fit against the transom 4. In a preferred embodiment, the bow end of the paddleboard 8 may end about 9 inches from the bow 3 of the boat 1, resulting in a paddleboard 8 with a length of about 10.5 feet.

In a second embodiment, the sides of the paddleboard 8 may extend at a downwardly angle to fit in a space existing between the bottom member 6 of the boat 1 and the inflated side tubes 2 of the boat 1. This alignment makes a connection similar to a tongue and groove fit between the inflatable paddleboard 8 and the inflated side tubes 2, forming a tighter fit inside the boat 1.

In an alternative embodiment of the invention, the paddleboard 8 and side tubes 2 may be connected more securely through an attachment device such as hook and loop strips 27, straps or another similar connecting device. Hook and loop strips 27 may be affixed to the side tubes 2, subsequently passing through loops affixed to the sides of the paddleboard 8, and then reattaching to the hook and loop strips 27 on the side tubes 2. Similarly, hook strips 27 may be affixed to the side tubes 2 and positioned to attach to loop strips 27 that may be affixed to the sides of the paddleboard 8.

The design of the inflatable boat 1 with inflatable paddleboard 8 floor is such that the paddleboard 8 may be removed and used as an independent watercraft. When at least one side tube 2 of the boat 1 is deflated, the air pressure drops, thereby loosening the frictional engagement between the side tubes 2 and the paddleboard 8. This loosening allows the paddleboard 8 to be separated and easily removed from the boat 1. The paddleboard 8 floor can then be used separately as an inflatable stand up paddleboard 8. The paddleboard 8 preferably includes a centrally located handle 24 to facilitate removal and transportability. It should be understood that the paddleboard 8 may contain any number of handles in any desired location(s) on the paddleboard 8, such as the center, sides, bow, stern, or any combination thereof. Any number of D rings 18 may be strategically attached to the paddleboard 8 for the securing and attachment of gear such as a cooler 16, paddles 17, fishing equipment, anchors, and the like. Additionally, these D rings 18 may be used to strap the paddleboard 8 to a vehicle or may be used for towing purposes. The paddleboard 8 may also be deflated, if necessary, for removal from the boat 1, transportability, and storage. This may be accomplished by releasing air from the inflation valve 28.

Additionally, the paddleboard 8 may include at least one removable fin 26 which may attach near the stern of the paddleboard 8. In a preferred embodiment, a track 29 may be permanently affixed to the bottom or water-side surface near the stern end of the paddleboard 8 whereby a fin 26 may slide into a groove 30 of the track 29 and further be secured by a locking pin 31 or the like. These fins 26 may be provided to improve directional stability of the paddleboard 8. Similarly, the removable fin mechanisms may also be attached to the bottom of the boat, if desired.

Although the inflatable boat 1 and stand up paddleboard 8 set forth herein may be described in terms of specific dimensions, it should be understood that these dimensions are used for illustrative purposes only, and other dimensions, shapes and sizes may be used while adhering to the spirit and scope of the present invention. Additionally, it is within the scope of the present invention that embodiments of this design could be used as a yacht tender.

What is claimed is:

1. An inflatable boat comprising:

A pair of elongated, inflatable tubes forming the sides of a boat, having a first end and a second end;

said tubes connected to each another at said first end, forming a bow;

a transom having a port and starboard ends;

the second end of each of said tubes connected to opposed ends of said transom, forming a stern;

a bottom member attached in a water tight manner to said tubes and said transom, said bottom member extending from said bow to said stern, forming a substantially watertight bottom;

an inflatable paddleboard that may be removably positioned between said tubes and on top of said bottom member for the purpose of creating buoyancy and forming a firm floor, said paddleboard having a bow end, a stern end, and sides and when removed may be used independently as a paddleboard.

2. The inflatable boat of claim 1, wherein said bow includes an arcuate curve.

3. The inflatable boat of claim 1, wherein said bottom member is constructed from material selected from the group consisting of plastic, rubber, and latex.

4. The inflatable boat of claim 1, wherein said stern includes a reinforced portion for attachment of a gas-powered or electric outboard motor.

5. The inflatable boat set forth in claim 1, further including a motor attached to said stern.

6. The inflatable boat of claim 1, further including a rowing frame comprising;

a first and second longitudinal support member attached to a top of and running parallel to each of said side tubes, a first and second lateral support member disposed in perpendicular relation to said side tubes and attached to said longitudinal support members such that a cooler may fit within said frame.

7. The inflatable boat of claim 6, wherein said frame is removably attached to said side tubes such that said frame may be detached.

8. The inflatable boat of claim 7, wherein said frame may be collapsed for portability and storage.

9. The inflatable boat of claim 6, wherein said lateral support members are each independently adjustable with respect to said longitudinal support members such that said lateral support members may slide in either direction along said longitudinal support members.

10. The inflatable boat of claim 6, wherein said frame further includes at least one pair of oarlocks removably attached to said longitudinal support members.

11. The inflatable boat of claim 6, wherein said frame includes adjustable oarlocks such that said oarlocks may slide in either direction along said longitudinal support members.

12. The inflatable boat of claim 1, wherein said paddleboard includes drop stitch construction of inflatable materials selected from the group consisting of polyester, nylon cloth coated with PVC, synthetic rubber, and latex.

13. The inflatable boat of claim 1, wherein said paddleboard is removably secured by frictional engagement between said paddleboard and said tubes and said bottom member.

14. The inflatable boat of claim 1, wherein said first and second sides of said removable floor curve in such a way that said paddleboard fits between and frictionally engages said tubes and said bottom member, further securing said paddleboard within said boat.

15. The inflatable boat of claim 1, wherein said paddleboard is removably secured within said inflatable boat with hook and loop fasteners.

16. The inflatable boat of claim 1, wherein at least one fin is affixed longitudinally to said boat.

17. The inflatable boat of claim 1, wherein at least one fin is removably attached longitudinally to said paddleboard.

18. The inflatable boat of claim 1, wherein at least one attachment mechanism is affixed to said paddleboard.

19. The inflatable boat of claim 18, wherein said attachment mechanism is a D-ring.

* * * * *